US005733672A

United States Patent [19]

Lambert

[11] Patent Number: 5,733,672

[45] **Date of Patent: *Mar. 31, 1998**

[54] INK ACCEPTOR MATERIAL CONTAINING A PHOSPHOLIPID

[75] Inventor: Ronald Frederick Lambert, Wayland, Mass.

[73] Assignee: Labelon Corporation, Canandaigua, N.Y.

[ * ] Notice: The term of this patent shall not extend beyond the expiration date of Pat. No. 5,474,843.

[21] Appl. No.: 658,395

[22] Filed: Jun. 5, 1996

Related U.S. Application Data

[63] Continuation of Ser. No. 168,467, Dec. 16, 1993, abandoned.

[51] Int. Cl.[6] ..... B41M 5/00

[52] U.S. Cl. ..... 428/704; 428/195; 428/211; 428/478.2; 428/478.8; 428/537.5; 428/704

[58] Field of Search ..... 428/195, 327, 428/447, 478.2, 478.8, 537.5, 704, 211

[56] References Cited

U.S. PATENT DOCUMENTS

| | | | |
|---|---|---|---|
| 4,371,582 | 2/1983 | Sugryama et al. | 428/341 |
| 4,379,804 | 4/1983 | Eisele et al. | 428/332 |
| 4,381,185 | 4/1983 | Swanson et al. | 8/506 |
| 4,547,405 | 10/1985 | Bedell et al. | 428/323 |
| 4,554,181 | 11/1985 | Cousins et al. | 428/341 |
| 4,578,285 | 3/1986 | Viola | 428/195 |
| 4,785,313 | 11/1988 | Higuma et al. | 346/1.1 |
| 4,857,386 | 8/1989 | Butters et al. | 428/206 |
| 4,877,680 | 10/1989 | Sakaki et al. | 428/500 |
| 4,935,307 | 6/1990 | Iqbal et al. | 428/500 |
| 4,944,988 | 7/1990 | Yasuda et al. | 428/195 |
| 5,180,425 | 1/1993 | Matrick et al. | 106/22 R |
| 5,180,624 | 1/1993 | Kojima et al. | 428/211 |
| 5,183,502 | 2/1993 | Meichsnër et al. | 106/22 K |
| 5,190,805 | 3/1993 | Atherton et al. | 428/195 |
| 5,192,617 | 3/1993 | Stofko et al. | 428/411.1 |
| 5,206,071 | 4/1993 | Atherton et al. | 428/195 |
| 5,219,928 | 6/1993 | Stofko, Jr. et al. | 428/331 |
| 5,223,338 | 6/1993 | Malhotra | 428/195 |

FOREIGN PATENT DOCUMENTS

| | | | |
|---|---|---|---|
| 0 484 016 A1 | 10/1991 | European Pat. Off. | 428/195 |
| 88045 | 7/1980 | Japan | 428/195 |
| WO 92/07722 | 5/1992 | WIPO | 428/195 |

OTHER PUBLICATIONS

"The Theory of the Photographic Process," Macmillan Publishing Co., Inc., New York, Fourth Edition, T.H. James, Editor; (see Chapter III, pp. 77–87, by Burness and Pouradier, entitled The Hardening of Gelatin and Emulsions).

Esprit Chemical Co. brochure "MR Series" published prior to Dec. 16, 1993.

*Primary Examiner*—Pamela R. Schwartz

*Attorney, Agent, or Firm*—Nixon, Hargrave, DeVans & Doyle

[57] ABSTRACT

An acceptor material for printing by ink-jet primers forms water-resistant, light-stable ink records with aqueous ink jet inks. The material comprises a support such as polyester film and a coating containing a water-soluble phospholipid mordant that forms insoluble compounds with and immobilizes the dyestuffs of the ink jet inks and a water managing polymer, preferably, hardened gelatin, which quickly renders the material dry-to-the-touch after contact with the aqueous ink.

14 Claims, 2 Drawing Sheets

INK ACCEPTOR MATERIAL CONTAINING A PHOSPHOLIPID

This application is a continuation of application Ser. No. 08/168,467, filed Dec. 16, 1993, now abandoned.

RELATED APPLICATIONS

Reference is made to the concurrently filed and commonly owned patent applications of Ronald F. Lambert and Edward J. Johnson entitled "Acceptor Material for Inks", now U.S. Pat. No. 5,474,843, and of Ronald F. Lambert entitled "Ink Acceptor Material Containing an Amino Compound", now U.S. Pat. No. 5,656,378.

FIELD OF THE INVENTION

This invention relates to an acceptor material for ink printing and, more particularly, to a coated acceptor material for forming water-resistant, light-stable ink records with ink jet inks.

BACKGROUND OF THE INVENTION

Ink jet printing is a non-impact means of producing a pattern of ink droplets which can be used to record digital information. To make a hard copy, the droplets are deposited onto a transparent, translucent, or opaque support such as film, vellum or paper. Ink jet printers have been used for many years to make monochrome hard copy from computers. A rapidly-growing use of ink jet printers is to generate subtractive color images using a three- or four-color process. The resultant hard copy can be viewed by transmitted light using an overhead projector (transparent film); by transmitted light using a diffuse illuminator (translucent film); or by reflected light (opaque support).

In subtractive continuous tone silver halide color photography, color images are produced by the superposition of three primary continuous-tone color-intensity-graduated recording layers. In non-continuous tone ink jet color printing, use is made of microscopic superposed color-separated dots (so-called halftone images) to create an impression to the viewer of an intensity graduated image. The proper hue, size, and degree of coalescence and mixing of the primary color dots—cyan, magenta, yellow and black—are necessary for the faithful reproduction of color on the recording medium. Accurate ink jet color image recording thus requires a high degree of cooperation between the ink jet color separation pulses, the ink dyestuffs, and the ink acceptor material.

An ink acceptor material should be capable of accepting the droplets readily and allowing them to coalesce, yet should achieve color isolation and separation with high chroma and pure hue without image edge distortions due to poor registration, bleeding, feathering, or other image quality defects. Acceptor materials for colored inks currently available, however, suffer from rapid fading of one or more of the dyestuffs upon exposure to light. Furthermore, currently available ink acceptor materials can be degraded easily by handling or by contact with moist objects. Fingers and other moist objects contacting the images often become stained with the dyestuffs. Also, because the usual aqueous ink jet inks have relatively low volatility, imaged acceptor materials are typically still wet with the aqueous ink vehicle when emerging from an ink jet printer. Images are then most vulnerable and can be altered by smudging or blocking (print stacking). Thus, there is a need for an ink acceptor material capable of rendering ink jet images which dry rapidly, are water resistant and light stable, can be handled and stacked without damage to the printing, and which have good layer clarity and gloss. The materials of the invention meet these needs.

SUMMARY OF THE INVENTION

The acceptor materials of the invention are useful particularly as receivers for thermal ink jet printing (bubble jet) or for non-thermal printing with inks comprising an aqueous vehicle and ionic, water-soluble, colored dyes, such as inks disclosed in U.S. Pat. Nos. 5,180,425 and 5,183,502 which are incorporated herein by reference. In general, however, they are useful in any process for printing information or images with such aqueous inks, including not only ink jet but also offset printing, gravure printing and the like. With such inks, of which the dyestuffs typically contain anionic groups such as carboxyl and/or sulfonate groups, the acceptor materials of the invention can provide images of high quality, which are water resistant and have excellent light stability. The preferred ink acceptor materials of the invention are also characterized by rapid drying, a quality of major importance in ink jet printing because of the high liquid content of the ink composition.

Acceptor materials of the invention function by independent management of the ionic ink jet dyestuffs and the aqueous ink vehicle. A water-soluble phospholipid mordant material reacts with and immobilizes the dyestuffs by forming a water-insoluble compound or coacervate while a solid water-absorbing polymer simultaneously wicks away the ink vehicle from the surface of the acceptor material. The mordant thereby controls the dye deposition and directs the dye movement (locus of dots) within the acceptor material to provide dot separation and coalescence-registration, thus maximizing the close-packing and permanence of the dyestuffs. The water-absorbent polymer controls the large volume of aqueous ink vehicle (for most aqueous inks, 70–90% of the composition) thus causing a rapid dry-to-the-touch, non-tacky response of the acceptor material with minimal dot beading, spreading and no blocking or smudging of the image. The result is a superior, full color ink jet image having excellent chroma and image resolution.

As disclosed in the concurrently filed patent application entitled "Acceptor Material for Inks", certain water-soluble polymeric quaternary ammonium compounds and electropositive metal ions are useful mordant materials for ionically bonding with the anionic dyestuffs of ink jet aqueous inks. These ionic mordants serve as dye management components in ink acceptor materials which contain chemically prehardened polymers as water management components. The ink acceptor materials of the present invention contain another class of dye management components that anchor and immobilize the anionic dyes of ink jet aqueous inks. The dye management components in the acceptor materials of the present invention are phospholipids that are water-soluble at room temperature.

The invention includes an acceptor material for inks that contain ionic dyestuffs and an aqueous liquid vehicle. Said acceptor material comprises a support and coated on the support, an ink-accepting composition comprising (a) a water-soluble phospholipid which, when admixed in excess with such an ionic dyestuff in aqueous solution at room temperature, forms a water-insoluble precipitate and a clear supernalant liquid, and (b) a water-absorbing, solid polymer, wherein said polymer is non-reactive with and permeable by said ionic dyestuffs. The mordant and water-absorbing polymer can be in separate layers on the support or in the same layer.

The invention further includes a novel imaged ink jet acceptor sheet which comprises a support and, on said support, a layer containing a water-absorbing polymer and, dispersed therein, a water insoluble coacervate of a water-soluble phospholipid compound and a water-soluble ionic dye compound.

BRIEF DESCRIPTION OF THE DRAWINGS

FIG. 1 shows a cross-section of an ink acceptor sheet of the invention in which the support is coated on one side with the ink accepting composition and on the other side with a backing layer to control conditions such as static, blocking, curl or the like.

DETAILED DESCRIPTION OF THE INVENTION

Figure 1:
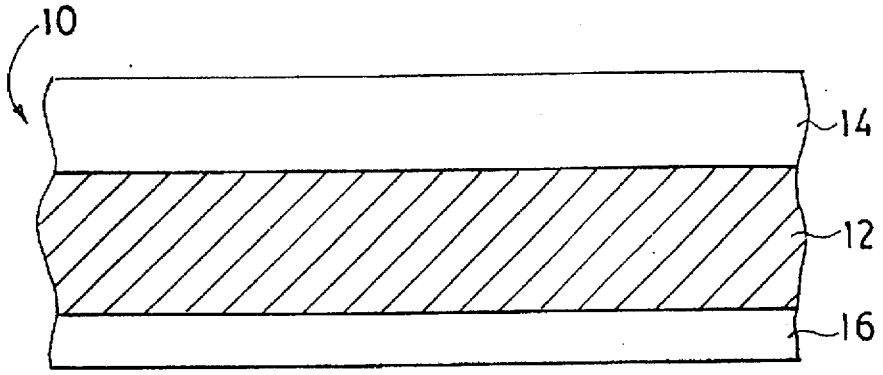

The ink acceptor material of the invention provides diffusion management of the deposited wet ink dots, the dyestuffs therein, and the liquid vehicle of the soluble dyes. Surprisingly, the applicants have found that water-soluble phospholipids, such as those disclosed hereinafter, are effective mordants or dye-immobilizing compounds for ionic dyestuffs as commonly used in ink jet inks and other printing inks.

The ink acceptor materials of the invention are prepared by coating and drying on a transparent, translucent or opaque sheet or web a layer or layers of the appropriate compositions. In one embodiment an aqueous coating composition is formed which contains both a water-absorbing polymer and a phospholipid mordant. In addition the composition preferably contains a hardening agent for the water-absorbing polymer, a coating aid and spherical polymeric beads which improve handling and/or sheet feeding properties of the ultimate sheet material without impairing transparency of the ink acceptor material. The coated layer is dried to form a thin layer in which the mordant is uniformly distributed throughout the water-absorbing polymer matrix. The total thickness of the dried ink receiving composition on the support, whether coated as one or a plurality of layers, is preferably in the range from about 1 to 25 μm, (although greater thicknesses can be used), and, most preferably, is in the range from about 2 to 18 μm. Preferably, spherical polymeric beads (as disclosed in the concurrently filed patent application of Ronald F. Lambert and Edward J. Johnson, now U.S. Pat. No. 5,474,843, the disclosure of which is incorporated herein by reference) are dispersed in the water-absorbing polymer and protrude from the polymer layer surface. The polymeric beads improve sheet handling and, with the water-absorbing polymer, contribute to rapid drying.

The water-absorbing polymers employed in the material of the invention have no affinity for the water-soluble ink jet dyes and therefore allow rapid diffusion of said dyes within the ink acceptor layer, wherein said dyes are rapidly immobilized by chemical reaction with the water-soluble phospholipid mordant to form a non-diffusing compound or coacervate. As indicated, the phospholipid can be distributed uniformly throughout the water absorbing polymeric matrix or it can be mixed with a portion of the water-absorbing polymer and coated in a separate layer above or below the water-absorbing layer. Although the applicants do not wish to be bound by theoretical explanations, it appears that a high percentage of the dyestuff reacts with mordant and is immobilized when the mordant is distributed throughout the water-absorbing or wicking polymer or is coated over it. The high optical density which characterizes the images formed by the acceptor materials of the invention appears to result from the high concentration of immobilized dye or coacervate caused by the unexpected reactivity of ink jet dyes with the phospholipids described herein.

Although the ink jet inks with which the ink accepting materials of the invention provide such outstanding results, are aqueous inks, it should be understood that, in addition to water, the ink vehicle can also include hydrophilic organic liquids. In general, the water content of the aqueous vehicle of the inks is in the range from about 30 to 99 weight percent, and preferably 70 to 90 weight percent, the rest being hydrophilic organic liquids such as glycols, glycol ethers, pyrrolidones and surfactants. As is known, such hydrophilic liquids can aid in the delivery of the inks by ink jet printers.

Referring to the drawings, FIG. 1 shows a preferred embodiment 10 of an acceptor material of the invention comprising support 12 and, coated on it, ink accepting composition 14. Support 12 is a sheet material which can be transparent, translucent, or opaque. Useful opaque sheet materials include paper, opaque filled polyester, polyethylene-clad paper, whim polypropylene film and the like. Useful transparent or translucent materials include, for example, poly(ethyleneterephthalate), cellulose acetate, polycarbonate, polyolefin, polyvinyl chloride, polystyrene, polysulfone, styrene acrylonitrile (also known as SAN), glass and the like. Support 12 can be coated with a conventional tie or subbing layer (not shown) to enhance adhesion of composition 14 to support 12, as well as one or more backing layers 16 to control conditions such as static, blocking, curl or the like.

Ink accepting composition 14 comprises a water-absorbing polymer, preferably a hardened polymer such as hardened gelatin. Upon being coated and dried, the polymer forms a matrix which is transparent to light, is insoluble in water at room temperature, and is resistant to abrasion. The polymer, however, retains its hydrophilic character, is easily swollen by water, is easily permeated by the aqueous ink vehicle and by water soluble dyestuffs, and has no chemical affinity for said dyestuffs. Hardenable polymers suitable for this purpose other than gelatin include, for example, chitosan, starch, agarose, albumen, casein, and gum arabic. Hardenable synthetic materials include, for example, hydroxy propyl cellulose (e.g., Klucel polymer of Hercules Corp.), carboxylated styrenebutadiene lattices, poly(acrylic acid), poly(methylvinylether-co-maleic arthydride), e.g., Gantrez 169 polymer, poly(vinyl alcohol), especially 100 percent hydrolyzed poly(vinyl alcohol), and poly(N-vinyl-4-pyrrolidone). Examples of other water-absorbing polymers which can be used with phospholipid mordants in accordance with the invention include aqueous liquid absorbing polymers disclosed in U.S. Pat. Nos. 5,192,617; 5,219,928; 4,379,804 and 5,180,624; and in International Patent Application PCT/US91/06686, International Publication Number WO92/07722 and the corresponding U.S. patent application Ser. No. 602,738 filed Oct. 24, 1990, and in the concurrently filed patent application of Lambert and Johnson entitled "Acceptor Material for Inks", now U.S. Pat. No. 5,474,843. The water-absorbing polymer can also have dispersed therein, as disclosed in the above cited, U.S. Pat. No. 5,474,843, polymer beads such as crosslinked poly (methyl methacrylate) beads or poly(dimethyl siloxane) beads of 3 to 15 μm diameter. The disclosures of these cited patents and applications are incorporated herein by reference.

Composition 14 further includes the water-soluble mordant or dye-fixing agent, which is a water-soluble phospholipid that is capable of bonding with the anionic dyestuffs in ink jet inks, to form a water-insoluble, immobile or "coacervate" compound in the acceptor matrix without any significant change in the chroma or hue of the original dyestuffs. Preferably, the mordant is distributed uniformly throughout the water-absorbing polymer of composition 14.

By water-soluble phospholipid is meant a phospholipid compound capable of dissolving in water at room temperature (20° C.) to a concentration of at least 10 gm/liter. Preferably, the phospholipid is water soluble to at least 30 gm/liter at room temperature.

The phospholipids in the ink acceptor materials of the invention bond to and anchor the dyes by mechanisms that are not fully understood. They all have in common, however, the fact that, when tested in the screening tests described hereinafter, they rapidly form precipitates with the dye when mixed therewith in aqueous solution at room temperature.

Phospholipids, also known as phosphatides, are derived from glycerol, fatty acids of from 14 to 22 carbon atoms, phosphoric acid and, for some phospholipids, from a nitrogen-containing compound. The phospholipids include the following: (1) phosphatidic acid and phosphatidylglycerols, (2) phosphatidylcholine, (3) phosphatidylethanolamine, (4) phosphatidylinositol, (5) phosphatidylserine, (6) iysophospholipids, (7) plasmalogens, and (8) sphingomyelins.

Specific examples of such water-soluble phospholipids useful as mordants in compositions of the invention include, lecithin (an aminophospholipid also known as phosphatidylcholine and as choline phosphoglyceride) and a group of phospholipids available from Mona Industries, Inc. and known as phospholipid EFA, phospholipid SV and phospholipid PTC. The latter phospholipids have the structure:

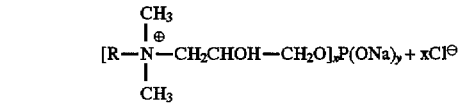

$$[R-\overset{CH_3}{\underset{CH_3}{\overset{|}{\underset{|}{N^{\oplus}}}}}-CH_2CHOH-CH_2O]_xP(ONa)_y + xCl^{\ominus}$$

wherein x and y are each 1 or 2 and x plus y=3. In such phospholipids R is a saturated or unsaturated long chain aliphatic carboxylic acid (e.g., of 14 to 22 carbon atoms) amido alkyl radical, the alkyl group having from 2 to 6 alkyl carbon atoms. In phospholipid EFA, R is linoleamidopropyl; in phospholipid SV, R is stearamidopropyl and in phospholipid PTC, R is cocamidopropyl.

All water-soluble phospholipids which pass a screening test A described herein are suitable as mordants in the materials of the invention for bonding to and immobilizing the anionic dyestuffs of ink jet inks. The selection of suitable phospholipid mordants can be facilitated by this simple screening test in which an aqueous solution of an anionic dyestuff which is present in the aqueous ink jet ink is mixed at room temperature (20° C.) with an aqueous solution of the phospholipid. The rapid formation of a coacervate or precipitate, which can be an oil or a solid, and a clear, substantially colorless supernatant liquid indicates the suitability of the phospholipid for use as a mordant in the ink acceptor materials of the invention. The screening can be carried out in two different ways but, Test A, illustrated hereinafter, is the preferred method for selecting and defining the mordants that are used in the acceptor materials of the invention. In this test, the mordant candidate is in a molecular excess. The suitability of the mordant is demonstrated by the rapid formation of a precipitate and by the fact that the supernatant liquid remains clear and substantially uncolored, thus showing that substantially all of the dye has been mordanted or converted to the insoluble precipate or coacervate. The test procedure is illustrated as follows:

Coacervation Screening Test A—Add dyestuff to Mordant Solution

Phospholipid Test 1000 picoliters of 5% magenta dyestuff in water is added at room temperature to 20 mg of phospholipid SV in 2 ml of water. A gelatinous red precipitate forms. The supernatant liquid is clear.

Poly(N-vinyl-4-pyrrolidone) Test

In the same manner the magenta dyestuff solution is added to an aqueous solution of poly(N-vinyl-4-pyrrolidone). No precipitate forms and the liquid is colored.

Test A shows that the phospholipid passes the screening test as a useful mordant but poly (N-vinyl-4-pyrrolidone) does not.

Test B, illustrated below, is another possible screening test for mordants. In this test an aqueous solution of the candidate mordant is added to an aqueous solution of the ink jet anionic dyestuff with which images are to be formed. Since the dyestuff is in excess, the supernatant liquid is colored. If the mordant candidate is suitable, then it forms a precipitate immediately or at least forms immediately a turbid suspension which can be centrifuged to obtain a precipitate. Thus either Test A or Test B can be used but Test A is preferred as a method for defining the suitable mordants because Test A shows that the dye reacts with the mordant and is removed from solution.

Coacervation Screening Test B—Add mordant to Dyestuff Solution

Phospholipid Test

To one ml of 5% magenta dyestuff aqueous solution is added 1000 picoliters of 5% aqueous solution of phospholipid SV. A heavy precipitate forms immediately.

Poly(N-vinyl-4-pyrrolidone) Test

In the same manner an aqueous solution of poly(N-vinyl-4-pyrrolidone) is added to the aqueous solution of dyestuff. No reaction occurs.

These screening tests show the rapid formation of a water-insoluble coacervate when a phospholipid is mixed with the water-soluble, anionic magenta dyestuff solution and shows that the phospholipid is suitable as a mordant in the ink acceptor materials of the invention. Poly(N-vinyl-4-pyrrolidone), however, forms no insoluble coacervate with the dyestuff and would not be selected as a mordant component of the materials of the invention.

Applicants have found that acceptor materials of the invention having exceptionally high gloss (which is very desirable for image quality) are obtained when the mordant is a phospholipid such as phospholipid EFA.

The acceptor material of the invention accepts the ink dots cleanly and allows sufficient coalescence time to achieve good dot registration, yet permits penetration of the inks to achieve proper hue and chroma without beading. At the moment of contact, the aqueous ink vehicle begins to diffuse into the acceptor layer, increasing the concentration of dyestuff in the applied droplets on the acceptor material surface. The ionic colored dyes also begin to diffuse into the layer where they are captured and bound irreversibly by the mordant as a coacervate which, in the single layer embodiment is distributed uniformly throughout the coated layer. The phospholipid mordant has a high affinity for the anionic dyestuffs and is present in such concentration that the dyes are mobilized. This coacervate formation causes each colored dye dot to be fixed in registration with good edge definition and the image quality is thus preserved. Also, the high concentration of dyestuff results in a high chroma (or color saturation) and efficient packing density of the dyes.

The vehicle for the dyes is wicked away from the uppermost surface rapidly by the hydrophilic water-absorbing polymer of the acceptor material. In effect, the coated layer performs a chromatographic separation of the ink composition, retaining the dyes on the mordant while permitting the liquid vehicle to diffuse readily to the unswelled portion of the polymer. This combination of actions results in good light stability, water fastness, and short drying times.

Figure 2:
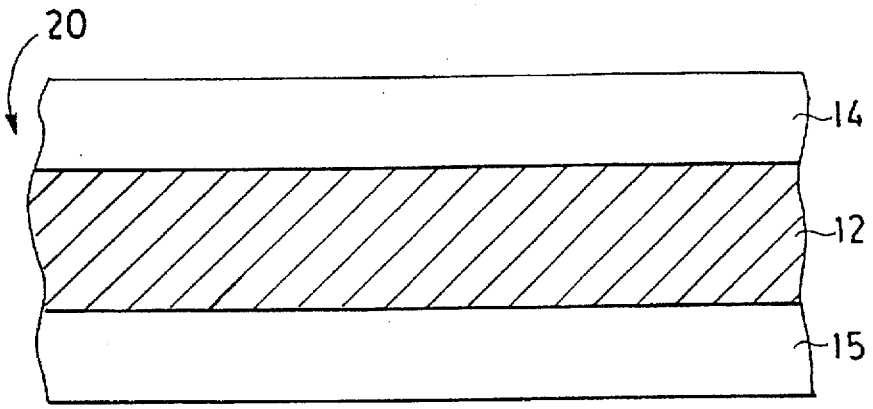
FIG. 2 shows a cross-section of an ink acceptor sheet of the invention in which the support is coated on two sides with ink accepting compositions.

FIG. 2 shows a another embodiment 20 of the invention wherein support 12 is coated on opposite sides with ink accepting compositions 14 and 15, which compositions can be the same or different, and which can be coated to the same or different thicknesses. The embodiments of FIGS. 1 and 2 can further include one or more protective overcoats (not shown) on top of ink-accepting layers 14 and 15.

Figure 3:
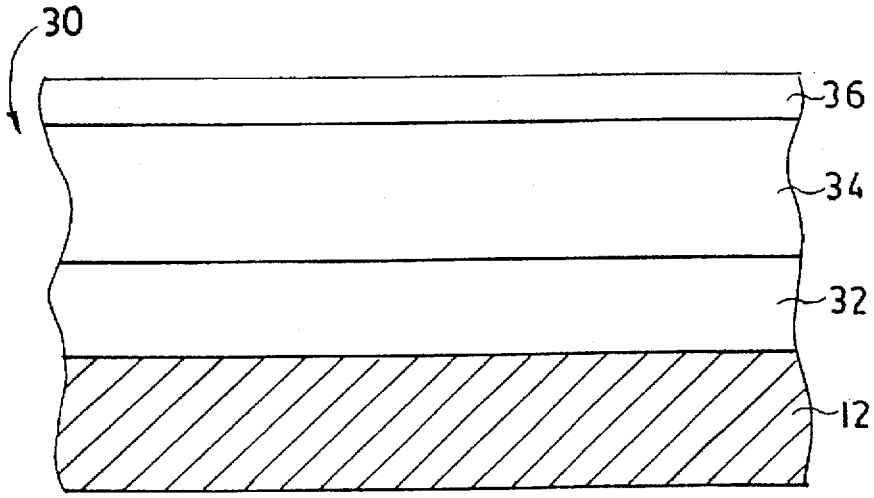
FIG. 3 shows a cross-section of an acceptor sheet of the invention in which the support is coated on one side with a dye mordanting layer, a liquid-absorbing layer, and an overcoat layer.

FIG. 3 shows still another embodiment 30 of the invention wherein an image-forming layer 32 containing the phospholipid mordant compound and a portion of the water-absorbing polymer is coated on support 12. Coated over layer 32 is a transparent, water-absorbing polymer layer which is substantially free of said mordant. The transparent water-absorbing polymer has no affinity for the ionic dyestuffs of the ink jet inks, which are captured completely and irreversibly by the mordant material in layer 32. This embodiment is suitable for outdoor display and for other uses when a high degree of protection for the image is desired, since the image layer is well below the upper surface of the film. If desired, the embodiment of FIG. 3 can be further protected by a transparent polymeric overcoat 36.

Figure 4:
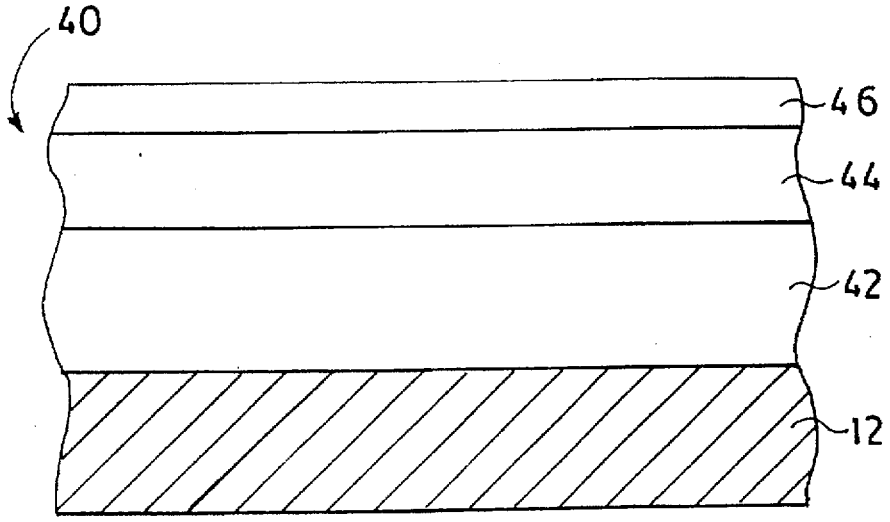
FIG. 4 shows a cross-section of another plural layer embodiment of the acceptor sheet of the invention.

FIG. 4 shows a further embodiment 40 of the invention wherein an image-forming mordant layer 44 is coated over the water-absorbing polymer of wicking layer 42. As in embodiment 30, a protective overcoat 46 may or may not be present. Embodiment 40 can be useful when the maximum possible image definition is desired, since the dyestuffs are captured near to the upper surface of the acceptor material before perceptible diffusion spreading of the imaging dots can occur.

When the water-absorbing polymer is a hardened polymer, the particular hardening agent to be used can vary according to the composition of the polymer to be hardened. A preferred hardener for gelatin is dimethyl hydantoin. Various aldehydes, e.g., formaldehyde, glutaraldehyde and succinaldehyde are also useful. Other useful gelatin hardeners are disclosed, in "The Theory of the Photographic Process," Macmillan Publishing Co., Inc., New York, Fourth Edition, T. H. James, Editor; (see Chapter III, pages 77–87, by Burness and Pouradier, entitled "The Hardening of Gelatin and Emulsions"), the disclosure of which is incorporated herein by reference. Hardening agents for other polymers include, for example, the trifunctional aziridine, trimethylol propane tris (β-aziridinyl) propionate, known as XAMA-7 which is available from Sanncor Co. The amount of hardening agent in the composition of the invention can vary over a considerable range. In general, however, the amount should be sufficient to render the polymer insoluble in water at temperatures below 50° C. while retaining water solubility at temperatures above about 50° C., so that the ink accepting composition of the invention can be coated on a support from an aqueous medium. In general, the desired amount of hardening agent can be determined by the equilibrium viscosity achieved by adding the agent. Sufficient hardening agent is added to increase the viscosity of the polymer from about 10 to 200% but not so much as to render it uncoatable. Preferred weight ratios of hardening agent to gelatin are in the range from about 1:1 to 1:10 although other ratios are also suitable. Other hardenable polymers can be hardened with similar ratios of hardening agent.

To prepare the composition of the invention for coating as a single layer on a support, preferably, the hardenable water-absorbing polymer, the hardening agent (if used), the water soluble phospholipid mordant and water are mixed together in a vessel with stirring and moderate heating. If desired, the polymer and hardener can be mixed before adding the mordant but it can be advantageous to add the mordant before the polymer is hardened. This can have the effect of grafting the soluble mordant compound to the wicking polymer. Other desirable components of the coating composition can be added before or after hardening the matrix polymer. These include a coating aid and polymeric beads as referred to above. The preferred synthetic polymeric beads or particles, e.g., poly(methylmethacrylate) and poly(dimethylsiloxane) beads are of 3 to 15 μm diameter. These bead materials are unexpectedly useful in improving the feeding and drying properties of the ink-acceptor sheets of the invention without substantially impairing their transparency.

Conventional coating techniques can be used for producing the coated ink acceptor materials of the invention, including, for example, spray coating, bar coating, extrusion die coating, air knife, knife over roll coating, reverse roll, curtain coating, blade coating and gravure coating of a continuous web of the support material. The coated web is dried in conventional manner e.g., by contact with warm air while passing through a drying chamber. The total thickness of the dried ink-accepting composition on the support; whether coated as one or a plurality of layers is preferably in the range from about 1 to 25 μm (although a greater thickness can be used) and most preferably is in the range from about 2 to 18 μm. The dried coated web can be wound on a take-up roll and later cut to desired sheet sizes.

The coated amount of water-absorbing polymer must be sufficient to absorb the substantial volume of water that is present in the ink jet ink. In general, an amount of water-absorbing polymer of at least about 2.0 grams per square meter on the support will adequately absorb the water in the ink jet droplets and will provide a quick-drying material. Likewise, the ink accepting composition must contain a sufficient amount of mordant to bind all of the dyestuff in the ink. In general, the amount of mordant should be at least about 0.5 weight percent and, preferably, at least 5 weight percent, of the amount of dry water-absorbing polymer in the ink accepting composition. The maximum mordant content should not be so high as to impair the desired physical properties of the acceptor material. Preferably, the mordant concentration does not exceed about 30 weight percent based on the weight of the water-absorbing polymer.

The examples which follow illustrate certain specific embodiments of the invention and describe comparative tests with commercially available ink jet acceptor materials.

EXAMPLE 1

A solution was prepared for coating in accordance with the invention. A vessel fitted with a mixer and a heater was charged with 93 grams of 10% suspension of gelatin T7188 from (K&K Corp.), in water and 40 grams of distilled water. The mixture was stirred and the temperature was raised to 49° C. (120° F.). After 5 minutes of stirring, the viscosity was 23 cps. Then 1.72 grams of a 55% aqueous solution of dimethyl hydantoin (Dantoin hardener, available from Lonza Co.) was added with continued stirring. After 10 minutes, the viscosity had increased to 35 cps, and no further increase was seen. Then was added 3.0 grams of 30% aqueous solution of phospholipid EFA (Mona Industries, Inc.) with stirring, followed by 0.23 gram of cross-linked poly(methyl methacrylate) beads (Soken MR-13G, 9–13 μm diameter, available from Esprit Chemical Co.) and 2.79 grams of aqueous solution of octylphenoxypolyethoxyethanol (Triton X-100 available from Union Carbide) as coating aid. The temperature was reduced to 38° C. (100° F.), and the resulting thickened solution was ready for coating.

The thickened solution was coated on transparent 3.85-mil poly(ethylene terephthalate) film (ICI 6138) at a dry coverage of 9 grams per square meter of support, resulting in a glossy, dried ink accepting layer 9 μm thick. When this film was imaged on a Hewlett-Packard 500C. DeskJet ink jet printer using a cartridge of Hewlett-Packard ink containing ionic dyes, the individual ink images emerged dry from the printer. Dot resolution was excellent.

A strip of the imaged film was immersed in water for two minutes, then removed and dried. Reflection magenta dye densities of immersed and non-immersed strips were measured with an X-Rite Densitometer, Model 408 and compared with those of a similarly printed and water-immersed commercial ink jet acceptor film. The magenta density change after water immersion for the film of the invention which contained the phospholipid mordant was only −0.03 but was −0.77 for the commercial film. This shows that essentially none of the dye was washed from the acceptor material of the invention and demonstrates its superior water resistance in comparison with the commercial film.

Light Exposure Testing of Example 1 Film of the Invention and a Commercial Film The non-immersed Example 1 film of the invention and a commercially available ink jet recording film which were identically printed in an ink jet printer were exposed to GE F400W fluorescent bulbs at 5,000 lux intensity for 72 hours, at the end of which time they were compared to otherwise identical unexposed strips (ASTM F767-82) of the same imaged films. The reflection density differences (indicating dye retention) are shown in Table I for the Example 1 film and for the commercial film.

TABLE I

Comparison of Light Exposure Results of Example 1 Film of the Invention and Commercial Film

| Dye | Density of Non-Exposed Film of Example 1 | Density of Exposed Film of Example 1 | Density Difference Between Non-Exposed and Exposed Film of Example 1 | Density Difference Between Non-Exposed and Exposed Commercial Film |
|---|---|---|---|---|
| Cyan | 1.42 | 1.30 | −0.12 | −0.59 |
| Magenta | 0.82 | 0.80 | −0.02 | −0.06 |
| Yellow | 0.76 | 0.73 | −0.03 | −0.11 |
| Black | 1.28 | 1.20 | −0.08 | −0.20 |

The optical density data in Table 1 show significantly better dye light stability for the film of the invention, especially for the cyan dye.

The next example describes a product of the invention in which the mordant is phospholipid PTC.

EXAMPLE 2

In this example the ink acceptor material was prepared substantially as in Example 1, except that a different water-soluble phospholipid was used as the mordant compound and the components of the coating composition were as follows:

| | |
|---|---|
| 20.00 g | 10% gelatin |
| 0.37 g | 55% Dantoin hardner |
| 1.00 g | 15.67% Phospholipid PTC |
| 0.60 g | 2% Triton X-100 coating aid |
| 0.05 g | GE SR 346 poly(dimethyl siloxane) beads, 7 to 12 μm diameter (available from General Electric Company) |
| 77.98 g | Water |

After coating on polyester film and drying, the coated film was printed with colored ink jet aqueous ink in a thermal ink jet printer. Dye densities measured for a sample of the film were: cyan, 1.44; yellow, 0.85; magenta, 0.97; and black, 1.88. A sample of the printed film had a magenta dye density before water immersion of 0.94. After the 2-minute water dip test, its magenta density measured 1.04. The density change of +0.07 indicates essentially no dye loss and excellent water resistance.

The invention has been described in detail with particular reference to preferred embodiments thereof, but it will be understood that variations and modifications can be effected within the spirit and scope of the invention.

I claim:

1. An ink image acceptor material for inks comprising ionic dyestuffs and an aqueous vehicle, said material comprising:

a support, and coated on one side of said support a water-soluble phospholipid mordant in an amount sufficient to immobilize all said ionic dyestuffs entering said material, which, when admixed in excess with said ionic dyestuffs in aqueous solution at room temperature, forms a water insoluble precipitate and a clear supernatant liquid, said mordant being dispersed in a water-absorbing polymer which is non-reactive with and permeable by said ionic dyestuffs, the amount of said mordant being at least about 0.5 weight percent of the amount of said water-absorbing polymer, said mordant comprising a phospholipid compound of the structure:

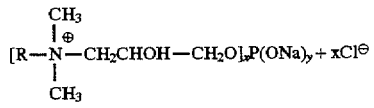

wherein x and y are each 1 or 2, x+y=3, and R is a $C_{14}$–$C_{22}$ saturated or unsaturated aliphatic carboxylic acid amidoalkyl radical, said alkyl having from 2 to 6 carbon atoms.

2. An ink image acceptor material of claim 1 wherein said phospholipid mordant is dispersed in said polymer in a single layer.

3. An ink image acceptor material of claim 1, which comprises a layer containing said polymer and said mordant and another layer which contains said polymer but no mordant.

4. An ink image acceptor material of claim 1 wherein said polymer is gelatin which has been pre-hardened by chemical reaction with a hardening agent prior to coating.

5. An ink image acceptor material of claim 1 wherein the amount of said mordant is at least about 5 weight percent of the amount of said water-absorbing polymer.

6. A ink image acceptor material according to claim 1 wherein R is lino leamidopropyl, stearamidopropyl or cocamidopropyl.

7. An ink image acceptor material of claim 6 which, when contacted by said inks, mordants said dyestuff preferentially onto surface sites of said mordant while permitting said aqueous vehicle to diffuse throughout said polymer.

8. An ink image acceptor material of claim 1 wherein said support is paper or a transparent or opaque plastic film.

9. An imaged ink jet acceptor sheet which comprises a support and, on said support, a layer containing a water absorbing polymer matrix and, dispersed therein, a water insoluble coacervate of a water-soluble phospholipid mordant compound and a water-soluble ionic dye compound.

10. An imaged ink jet acceptor sheet of claim 9 wherein said polymer matrix comprises gelatin that has been pre-hardened by chemical reaction with a hardening agent prior to coating.

11. An imaged ink jet acceptor sheet of claim 9 wherein said support comprises paper or a transparent or opaque plastic film.

12. An imaged ink jet acceptor sheet of claim 9 wherein said phospholipid mordant comprises a compound of the structure:

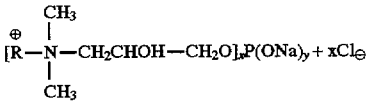

wherein x and y are 1 or 2, x+y=3 and R is a $C_{14}$–$C_{22}$ saturated or unsaturated aliphatic carboxylic acid amidoalkyl radical, said alkyl having from 2 to 6 carbon atoms.

13. An imaged ink jet acceptor sheet of claim 12 wherein R is a linoleamidopropyl, stearamidopropyl, or cocamidopropyl radical.

14. An imaged ink jet acceptor sheet of claim 9 wherein said phospholipid mordant comprises lecithin.

* * * * *